US007910207B2

(12) United States Patent
Kamiyama et al.

(10) Patent No.: US 7,910,207 B2
(45) Date of Patent: Mar. 22, 2011

(54) ISLANDS-IN-SEA TYPE COMPOSITE FIBER AND PROCESS FOR PRODUCING SAME

(75) Inventors: Mie Kamiyama, Matsuyama (JP); Miyuki Numata, Matsuyama (JP)

(73) Assignee: Teijin Fibers Limited, Osaka (JP)

( * ) Notice: Subject to any disclaimer, the term of this patent is extended or adjusted under 35 U.S.C. 154(b) by 0 days.

(21) Appl. No.: 12/576,593

(22) Filed: Oct. 9, 2009

(65) Prior Publication Data

US 2010/0029158 A1 Feb. 4, 2010

Related U.S. Application Data

(62) Division of application No. 10/592,667, filed as application No. PCT/JP2005/006734 on Mar. 30, 2005, now Pat. No. 7,622,188.

(30) Foreign Application Priority Data

Mar. 30, 2004 (JP) ..... 2004-098392

(51) Int. Cl.
*B32B 19/00* (2006.01)

(52) U.S. Cl. ..... 428/357; 428/373; 428/374

(58) Field of Classification Search ..... 428/370, 428/373, 374, 357
See application file for complete search history.

(56) References Cited

U.S. PATENT DOCUMENTS

| | | | | |
|---|---|---|---|---|
| RE031,601 | E | 6/1984 | Ikeda et al. | |
| 4,704,329 | A * | 11/1987 | Hancock et al. | 428/369 |
| 4,929,503 | A * | 5/1990 | Shirasaki et al. | 428/373 |
| 5,637,385 | A * | 6/1997 | Mizuki et al. | 442/361 |
| 5,698,322 | A * | 12/1997 | Tsai et al. | 428/373 |
| 6,761,970 | B2 | 7/2004 | Ochi et al. | |
| 6,838,172 | B2 | 1/2005 | Yoon et al. | |
| 7,144,974 | B2 * | 12/2006 | Honda et al. | 528/279 |
| 7,267,789 | B2 | 9/2007 | Chhabra et al. | |
| 7,356,229 | B2 | 4/2008 | Ouderkirk et al. | |
| 7,356,231 | B2 | 4/2008 | Ouderkirk et al. | |

(Continued)

FOREIGN PATENT DOCUMENTS

CN 1439751 9/2003

(Continued)

OTHER PUBLICATIONS

Island-in-sea type conjugate fiber and its properties, Industrial Texture, vol. 21, 155, p. 38-41.

(Continued)

*Primary Examiner* — N. Edwards
(74) *Attorney, Agent, or Firm* — Sughrue Mion, PLLC

(57) ABSTRACT

The islands-in-sea type composite fiber of the present invention comprises a sea part containing an easily soluble polymer and 100 or more island parts containing a hardly soluble polymer, per fiber. In a cross-sectional profile of the composite fiber, each of the island parts has a thickness in the range of from 10 to 1,000 nm and the intervals between the island parts adjacent to each other are 500 nm or less. The islands-in-sea type composite fiber is produced by melt spinning the sea part polymer and the island part polymer mentioned above through a spinneret for an islands-in-sea type composite fiber and taking up the spun fiber at a speed of 400 to 6,000 m/min. Dissolution and removal of the sea part polymer from the composite fiber gives a group of fine fibers having a thickness of 10 to 1,000 rim and useful for clothing, industrial materials and other applications.

8 Claims, 2 Drawing Sheets

U.S. PATENT DOCUMENTS

| | | | | |
|---|---|---|---|---|
| 7,362,943 | B2 | 4/2008 | Ouderkirk et al. | |
| 7,386,212 | B2 | 6/2008 | Ouderkirk et al. | |
| 7,406,239 | B2 | 7/2008 | Ouderkirk et al. | |
| 7,622,188 | B2 * | 11/2009 | Kamiyama et al. | 428/370 |
| 7,662,188 | B2 * | 2/2010 | Yamada | 623/17.17 |
| 2004/0006857 | A1 | 1/2004 | Romani | |
| 2007/0196649 | A1 * | 8/2007 | Kamiyama et al. | 428/373 |
| 2010/0029158 | A1 * | 2/2010 | Kamiyama et al. | 442/192 |

FOREIGN PATENT DOCUMENTS

| | | | |
|---|---|---|---|
| CN | 145321 | | 11/2003 |
| EP | 0250209 | A1 | 12/1987 |
| EP | 0427232 | A2 | 5/1991 |
| JP | 53-119317 | A | 10/1978 |
| JP | 58-12367 | B | 3/1982 |
| JP | 60-28922 | B | 1/1984 |
| JP | 08-284021 | A | 10/1996 |
| JP | 2000-110028 | | 4/2000 |
| JP | 2004169261 | A | 6/2004 |
| JP | 2004-277966 | A | 10/2004 |
| TW | 305886 | | 5/1997 |
| TW | 522181 | | 3/2003 |
| WO | 02/44447 | A1 | 6/2002 |
| WO | 2004/038073 | A | 5/2004 |

OTHER PUBLICATIONS

European Paten Communication; Reference P04427OEP; Application No. 05728636.1-2109 PCT/JP2005006734; Date Jun. 10, 2008; 3 pages.

Japanese Office Action; 2006-511882; Dec. 9, 2008; 3 pages.

* cited by examiner

ISLANDS-IN-SEA TYPE COMPOSITE FIBER AND PROCESS FOR PRODUCING SAME

CROSS REFERENCE TO RELATED APPLICATIONS

This is a divisional of application Ser. No. 10/592,667 filed Sep. 13, 2006, which is a 371 of PCT/JP2005/006734 filed Mar. 30, 2005, the disclosures of all of which are incorporated by reference herein.

TECHNICAL FIELD

The present invention relates to an islands-in-sea type composite fiber and, particularly, to an islands-in-sea type composite fiber having a very large number of island parts. The present invention relates, in more detail, to an islands-in-sea type composite fiber that has an extremely low content of a sea part and from which a fine fiber group having a very large number of filaments can be easily obtained by dissolving and removing the sea part, and a process for producing the same.

BACKGROUND ART

Very many processes and apparatuses for producing an islands-in-sea type composite fiber have heretofore been proposed. However, even when the number of island parts can be increased, there is the problem that the mass proportion (island proportion) of the island parts to the sea part is hard to increase. That is, when an attempt is made to increase the island proportion, the following problems arise: the relationship between the sea part and the island parts is reversed, and the problem that the polymer used for forming the island parts is brought into a continuous state to form the sea part; and the problem that even though the number of island parts can be increased, the area of each extrusion orifice of the spinneret becomes very large. Moreover, in such cases, the sites and number of the island parts are hard to adjust, and various problems arise to such a degree that a nonuniform composite fiber cannot be obtained.

For example, a process for producing an islands-in sea type composite fiber having very many islands is disclosed in Patent Reference 1 (JP-58-12367-B). This process comprises the steps of forming a plurality of island-in-sea type composite streams in an up stream part of a spinning system, gathering the composite streams in each of a plurality of the primary funnel-like portions, mutually gathering the primary gathered composite streams at a secondary funnel-like portion arranged in the downstream part of the spinning system, and extruding the resultant secondary gathered composite stream through an extrusion orifice. The process surely increases the number of islands. However, the extrusion orifices of the spinneret are complicated and costly, and the operationability in the production steps is difficult. Moreover, in order to prepare fine fibers wherein the number of the island parts is 200 or more, and the thickness of the island parts is 0.0095 dtex or less, the amount of the sea part must be increased. The mass ratio of the sea part to the island parts must therefore be 1:1 or more. As a result, the problem that the amount of a sea part polymer to be dissolved and wasted is still large, remains.

On the other hand, in Patent Reference 2 (JP-60-28922-B), a process for producing a fiber composed of an aggregate of fine and short polymer fibers is disclosed. This process comprises the steps of forming an islands-in-sea type mixed spun fiber from mixed composite polymers prepared by using a static mixer, and removing the sea part. However, because the island phases are formed by blending, the uniformity is inadequate. Moreover, the fiber is an aggregate fiber formed from fine fibrils each having a finite length in the longitudinal axis direction of the fiber. As a result, the fiber has the problem that the strength is low.

[Patent Reference 1] Japanese Examined Patent Publication (Kokoku) No. 58-12367

[Patent Reference 2] Japanese Examined Patent Publication (Kokoku) No. 60-28922

DISCLOSURE OF THE INVENTION

An object of the present invention is to provide an islands-in-sea type composite fiber the sea part of which can be easily dissolved and removed even when the content of the island parts is high and from which a fine fiber group having very many filaments is obtained, and a process for producing the same.

The above object can be achieved by the islands-in-sea type composite fiber and the process for producing the same of the present invention.

The islands-in-sea type composite fiber of the present invention comprises a sea part comprising an easy-soluble polymer and a plurality of island parts comprising a hardly-soluble polymer, in the cross-sectional profile of which each of the island parts has a thickness in the range of from 10 to 1000 nm, the number of the island parts is 100 or more per fiber and the intervals between the island parts adjacent to each other are 500 nm or less.

In the islands-in-sea type composite fiber of the present invention, the number of the island parts is preferably 500 or more per fiber.

In the islands-in-sea type composite fiber of the present invention, the variability in cross sectional thickness of the island parts represented by CV % is preferably in the range of from 0 to 25%.

In the islands-in-sea type composite fiber of the present invention, the mass ratio of the sea part to the island parts per composite fiber is preferably in the range of from 40:60 to 5:95.

In the islands-in-sea type composite fiber of the present invention, the ratio in dissolving rate of the sea-part polymer to the island-part polymer is preferably 200 or more.

In the islands-in-sea type composite fiber of the present invention, the easily soluble polymer for the sea part preferably comprises at least one polymer easily soluble in aqueous alkali solutions selected from the group consisting of polylactic acid, super high molecular weight polyalkyleneoxide-condensate polymers, polyethyleneglycol compound-copolymerized polyesters, and copolymerized polyesters of polyethylene glycol compounds with 5-sodium sulfoisophthalic acid.

In the islands-in-sea type composite fiber of the present invention the copolymerized polyesters of polyethyleneglycol compounds with 5-sodium sulfoisophthalic acid are preferably selected from polyethylene terephthalate copolymers in which 6 to 12 molar % of 5-sodium sulfonic acid and 3 to 10% by weight of polyethylene glycol having a molecular weight of 4000 to 12000 are copolymerized.

In the islands-in-sea type composite fiber of the present invention, in the case where four straight lines pass through the center of the cross-sectional profile of the composite fiber, at angular intervals of 45 degrees, the cross sectional thickness (r) of the island parts, and a smallest intervals (S min) between the island parts located on the four straight lines, and the cross sectional thickness (R) of the composite fiber and a largest intervals (S max) of the island parts located on the four straight lines preferably satisfy the following requirements (I) and (II):

$$0.001 \leqq S\,\mathrm{min}/r \leqq 1.0 \quad \text{(I)}$$

and $$S\,\mathrm{max}/R \leqq 0.15 \quad \text{(II)}$$

In the islands-in-sea type composite fiber of the present invention, a stress-strain curve of the composite fiber determined at room temperature preferably has a yield point of the composite fiber due to break of the sea part and a breaking point of the composite fiber due to the break of the island parts.

In the islands-in-sea type composite fiber of the present invention, the sea part preferably comprise a nylon polymer and is soluble in formic acid.

The islands-in-sea type composite fiber of the present invention may be an undrawn fiber.

The islands-in-sea type composite fiber of the present invention may be a drawn fiber.

The process of the present invention for producing an islands-in-sea type composite fiber of the present invention, as mentioned above, comprises the steps of melt-extracting a polymer for a sea part comprising an easily soluble polymer and a polymer for island parts comprising a hardly soluble polymer having a lower melt viscosity than that of the easily soluble polymer, through a spinneret for an islands-in-sea type composite fiber; and taking up the extruded islands-in-sea type composite filament at a spinning speed of 400 to 6000 m/min.

The process of the present invention for producing an islands-in-sea type composite fiber optionally further comprises a step of drawing the taken-up composite filament at a temperature of 60 to 220° C. to orientate and crystallize the composite filament.

The process of present invention for producing an islands-in-sea type composite fiber optionally further comprises steps of pre-heating the taken-up filament on a pre-heating roller at a temperature of 60 to 150°; drawing the pre-heated filament at a draw ratio of 1.2 to 6.0; heat setting the drawn filament on a heat-setting roller at a temperature of 120 to 220° C.; and winding up the heat-set filament.

In the process of the present invention for producing an islands-in-sea type composite fiber, in the melt-extruding step, the ratio in the melt viscosity of the polymer for the sea part to the polymer for the island parts is in the range of from 1.1 to 2.0.

In the process of the present invention for producing an islands-in-sea type composite fiber, each of the polymer for the sea part and the polymer for the island parts preferably has a glass transition temperature of 100° C. or less, and the process optionally further comprises the step of, between the taking up step and the orientating and crystallize-drawing step, pre-fluidization drawing the taken-up islands-in-sea type composite filament at a draw ratio of 10 to 30 at a drawing speed of 300 m/min or less while the filament is immersed in a liquid bath having a temperature of 60 to 100° C.

The fine fiber bundle of the present invention is prepared from the islands-in-sea type composite fiber as mentioned above by dissolving and removing the sea part from the composite fiber.

In the fine fiber bundle of the present invention, the individual fine fibers in the fine fiber bundle preferably have a variability (CV %) in thickness of 0 to 25%.

The fine fiber bundle of the present invention preferably has a tensile strength of 1.0 to 6.0 CN/dtex, an elongation at break of 15 to 60% and a dry heat shrinkage at 150° C. of 5 to 15%.

The textile product of the present invention comprises a fine fiber bundle as mentioned above.

The textile product, of the present invention is preferably in the form of a woven or knitted fabric, a felt, a nonwoven fabric, a braid-like yarn or a spun yarn.

The textile product, of the present invention is preferably selected from clothes, interior materials, industrial materials, home life materials, environment-maintaining materials, and medical and sanitary materials.

The effects of the present invention are as explained below.

According to the islands-in-sea type composite fiber of the present invention, a multifilament yarn that is composed of fine individual fibers and that has a mechanical strength sufficient for practical use can be easily obtained by dissolving and removing the sea part. Moreover, according to the production process of the invention, even when the proportion of the sea part is decreased, an islands-in-sea type composite fiber having a uniform island part thickness can be easily produced.

BEST MODE FOR CARRYING OUT THE INVENTION

Figure 1:
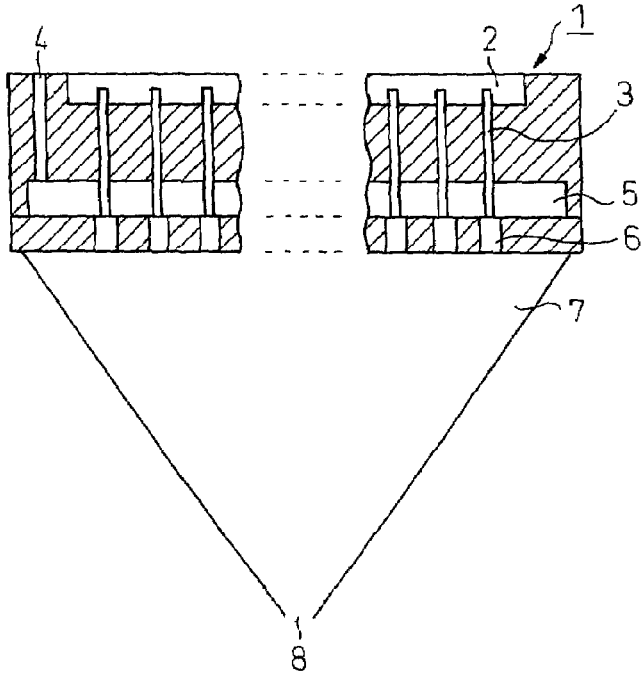
FIG. 1 is a cross-sectional explanatory view of a portion of one embodiment of a spinneret used for spinning the islands-in-sea type composite fiber of the present invention.

Polymers forming the islands-in-sea type composite fiber of the present invention can be suitably selected as long as the sea part polymer is used in combination with an island part polymer while the solubility of the former polymer is higher than that of the latter one. In particular, the ratio in dissolving rate of the former polymer to the latter polymer (sea/islands) is preferably 200 or more. When the ratio in dissolving rate is less than 200, part of the island parts in the surface layer portion of the fiber cross section are dissolved while the sea part in the central portion of the fiber cross section is being dissolved. As a result, in order to completely dissolve and remove the sea part, several tens of percentage of the island parts is reduced. Uneven thickness of the island parts and deterioration of the strength of the island parts caused by solvent corrosion are generated. Fluffs and pilling are consequently produced to lower the quality of the products.

Although any polymer may be used as the sea part polymer as long as the above ratio in dissolving rate is preferably satisfied, polymers such as a polyester, a polyamide, a polystyrene and a polyethylene that have fiber formability are particularly preferred. Appropriate examples of an aqueous alkali solution-easily soluble polymer include a polylactic acid, an ultrahigh molecular weight polyalkylene oxide condensation polymer, a polyethylene glycol compound-copolymerized polyester and a polyester copolymer in which a polyethylene glycol compound and 5-sodium sulfoisophthalate are copolymerized. Moreover, a nylon 6 is soluble in formic acid, and a polystyrene-polyethylene copolymer is very soluble in organic solvents such as toluene.

Of these, in order to make the alkali easy solubility and the islands-in-sea cross section-formability of the sea part polymer compatible, a preferred example of the polyester polymer is a polyethylene terephthalate polyester copolymer in which 6 to 12% by mole of 5-sodium sulfoisophthalate and 3 to 10% by weight of a polyethylene glycol having a molecular weight of 4,000 to 12,000 are copolymerized and that has an intrinsic viscosity of 0.4 to 0.6. 5-Sodium sulfoisophthalate herein contributes to improve the hydrophilicity and melt viscosity of the copolymer thus obtained, and the polyethylene glycol (PEG) herein improves the hydrophilicity of the copolymer. In addition, a PEG having a larger molecular weight shows a greater effect of increasing hydrophilicity thought to be caused by the high order structure. However, the reactivity with the acid part is lowered, and the reaction product thus obtained becomes a blend type. Accordingly, a PEG having a large molecular weight is not preferred in view of the heat resistance and spinning stability of the product. Moreover, because PEG initially has a function of lowering the melt viscosity, the copolymer thus obtained hardly achieves the object of the present invention when the copolymerized amount of the PEG becomes 10% by weight or more. Accordingly, both components are preferably copolymerized in the above range.

On the other hand, any polymer may be used the island part polymer as long as there is a difference in a dissolving rate between the polymer and the sea part polymer. However, polymers such as a polyester, a polyamide, a polystyrene and a polyethylene that have a fiber formability are particularly preferred. Of these polymers, for a polyester for clothing articles, a polyethylene terephthalate, a polytrimethylene terephthalate, a polybutylene terephthalate, and the like, are preferred. For a polyamide, a nylon 6 and a nylon 66 are preferred. On the other hand, in order to use a fine fiber bundle for fine fiber woven fabrics, etc., industrial materials, medical materials and cleaning devices such as filters, use of polymers such as a polystyrene and a polyethylene that are durable against water and acid, and alkaline materials, as the island part polymer is preferred in view of the durability.

For the islands-in-sea type composite fiber of the invention comprising the above sea part polymer and the above island part polymer, the melt viscosity of the sea part polymer during melt spinning is preferably higher than that of the island part polymer. When such a relationship exists, the following never take place even in the case where the composite mass ratio of the sea part becomes as low as less than 40%: the island parts are mutually bonded; or most of the island parts are mutually bonded to form a fiber different from the islands-in-sea type composite fiber.

The melt viscosity ratio (sea part/island parts) is preferably from 1.1 to 2.0, more preferably from 1.3 to 1.5. When the ratio is less than 1.1, the island parts are likely to be mutually bonded although the process is stabilized. On the other hand, when the ratio exceeds 2.0, the viscosity difference excessively increases to lower the stability of the spinning step.

Next, when the number of island parts is large, the productivity during the production of the fine fibers by dissolving and removing the sea part increases; moreover, the fine fibers thus obtained become significantly thin, and the softness, smoothness, luster, and the like, specific to ultra-fine fibers can be manifested. It is therefore important that the number of island parts be 100 or more, more preferably 500 or more. In the case where the number of island parts is less than 100, a multifilament yarn composed of individual fine fibers cannot be obtained even when the sea part is dissolved and removed, and the object of the present invention cannot be achieved. In addition, when the number of the island parts excessively increases, not only the production of the spinneret becomes costly, but also the working precision itself of the spinneret is lowered. The number of the island parts is therefore preferably made 1,000 or less.

Moreover, it is necessary that the thickness of each of the island parts be from 10 to 1,000 nm, and preferably from 100 to 700 nm. A thickness of less than 10 nm is not preferred because the fiber structure itself is not stabilized, and neither the physical properties nor the fiber form is stabilized. On the other hand, a thickness exceeding 1,000 nm is not preferred because softness and a feel specific to the ultra-fine fibers are not obtained. Furthermore, when each of the island parts in a cross-sectional profile of the islands-in-sea type composite fiber has a more uniform thickness, the high multifilament yarn composed of fine fibers obtained by removing the sea part show more improved quality and durability.

Furthermore, for the islands-in-sea type composite fiber of the present invention, the mass ratio of the sea part to the island parts (sea part:island parts) per composite fiber is preferably in the range of from 40:60 to 5:95, and particularly preferably from 30:70 to 10:90. When the mass ratio is in the above range, the thickness of the sea part between the island parts can be decreased. As a result, the sea part can be easily dissolved and removed, and the island parts are readily converted into fine fibers. When the proportion of the sea part herein exceeds 40%, the thickness of the sea part becomes excessively large. On the other hand, when the proportion is less than 5%, the amount of the sea part becomes too small, and mutual bonding of the island parts is likely to take place.

For the islands-in-sea type composite fiber of the present invention, the elongation at break of the island parts is preferably greater than that of the sea part. Moreover, in the case where four straight lines pass through the center of the cross-sectional profile of the composite fiber, at angular intervals of 45 degrees, when the cross-sectional thickness (r) of the island parts, a smallest intervals ($S_{min}$) between the island parts located on the four straight lines, the cross sectional thickness (R) of the composite fiber and a largest intervals ($S_{max}$) of the island parts located on the four strength lines satisfy the following requirements (I) and (II):

$$0.001 \leqq S_{min}/r \leqq 1.0 \quad \text{(I)}$$

and $$S_{max}/R \leqq 0.15 \quad \text{(II)},$$

fine fibers having a mechanical strength that withstand practical uses can be obtained.

However, when the central portion of the composite fiber is formed out of a sea part in the measurement of intervals among the island parts, an interval between two island parts that are adjacent to each other through the central portion is excluded. From the explanation above, the requirements are preferably as follows: $0.01 \leqq S_{min}/r \leqq 0.7$; and $S_{max}/R \leqq 0.08$. When the $S_{min}/r$ value exceeds 1.0, or when the $S_{max}/R$ value exceeds 0.15, the high speed spinnability during the production of the composite fiber becomes poor, or the draw ratio cannot be increased. As a result, the physical properties of the drawn yarn of the islands-in-sea type composite fiber thus obtained become poor, and the mechanical strength of the fine fibers obtained by dissolving and removing the sea part is lowered. When the $S_{min}/r$ value is less than 0.001, it is highly possible that the island parts mutually stick together.

Furthermore, for the islands-in-sea type composite fiber of the present invention, the intervals between the island parts adjacent to each other are 500 nm or less, and preferably in the range from 20 to 200 nm. When the intervals between the island parts exceed 500 nm, dissolution of the island parts proceeds during dissolving and removing the sea part occupying the intervals. As a result, not only the uniformity of the island parts is lowered, but also defect formation such as fluff formation and pilling during wearing of the clothes prepared by putting the fine fibers formed out of the island parts into practical use, and uneven dyeing, are likely take place.

The islands-in-sea type composite fiber of the present invention explained above can be easily produced by, for example, the process explained below. That is, first, a polymer that has a high melt viscosity and that is easily soluble and a polymer that has a low melt viscosity and that is hardly soluble are melt spun in such a manner that the former polymer forms a sea part and the latter polymer forms island parts. The relationship between the melt viscosity of the sea part and that of the island parts herein is important. When the content of the sea part is lowered and the intervals between the island parts are decreased, the sea part comes to flow at high speed through part of the flow paths between the island parts within the melt spinning spinneret of the composite fiber in the case where the melt viscosity of the sea part is low. As a result, mutual bonding between the island parts unpreferably tends to take place.

In a stress-strain curve at room temperature of the islands-in-sea type composite undrawn fiber for fine fibers, a yield point corresponding to a partial break of the sea part is sometimes manifested. This is a phenomenon observed when the orientation of the sea part proceeds due to the fast solidification of the sea part in comparison with the island parts and, on the other hand, when the orientation of the island parts is low due to the influence of the sea part. The first yield point signifies a partial breaking point of the sea part (the point being defined as an elongation at partial break $I_p$%), and the island parts showing a low orientation are elongated after the yield point. Moreover, both the island parts and the sea part are broken at the breaking point of the stress-strain curve (the point being defined as an elongation at total break $I_t$%). These phenomena can be explained from the fact that the first yield point is transferred more to the initial stage when the spinning speed is increased. An ordinary stress-strain curve may of course be shown in place of the stress-strain curve at room temperature.

Figure 2:
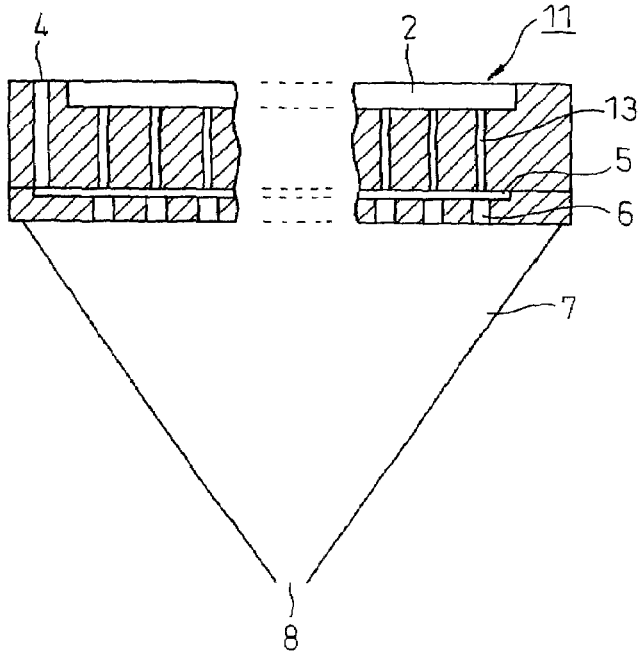
FIG. 2 is a cross-sectional explanatory view of a portion of another embodiment of a spinneret used for spinning the islands-in-sea type composite fiber of the present invention.

As the spinneret used for melt spinning an islands-in-sea type composite fiber of the invention, a group of hollow pins, a group of fine pores, for forming island parts can be suitably used. For example, any spinneret may be used as long as the following processing can be achieved: island parts extruded through hollow pins or fine pores and sea part flows supplied from flow paths designed to make the sea part flows fill the gaps between the island parts are combined; the combined flow is gradually made thin, and extruded through an extrusion orifice to form an islands-in-sea type composite fiber. One embodiment of a preferably used spinneret is shown in FIG. 1, and another embodiment of a preferably used spinneret is shown in FIG. 2. However, the spinneret usable in the process of the present invention is not necessarily restricted thereto. In a spinneret 1 shown in FIG. 1, a polymer (melt) for island parts prior to distribution in a polymer pool 2 for island parts is distributed into polymer introduction paths 3 for island parts formed by a plurality of hollow pins. Separately, a polymer (melt) for a sea part prior to distribution is introduced into a polymer pool 5 for a sea part through a polymer guiding path 4 for a sea part. Each of the hollow pins from which the polymer introduction paths 3 for island parts are formed, passes through the polymer pool 5 for a sea part, and opens downward in the central portion of each corresponding inlet of a plurality of flow paths 6 for core-in-sheath type composite streams provided below the pool 5. Each island part polymer stream is introduced into the central portion of the corresponding flow path 6 for a core-in-sheath type composite streams from the lower end of one of the polymer introduction paths 3 for island parts. Each polymer stream for a sea part in the polymer pool 5 for a sea part is introduced into the corresponding path 6 for a core-in sheath type composite flow so that the polymer stream for a sea part surrounds the corresponding island part polymer stream to form a core-in-sheath type composite stream wherein the island part polymer stream forms a core part, and the corresponding sea part polymer stream forms a sheath part surrounding the core part. A plurality of core-in-sheath type composite streams are then introduced into a funnel-shaped combination path 7 in which the sheath portions of a plurality of the core-in-sheath type composite streams are bonded to each other to form an islands-in-sea type composite flow. While the composite stream is flowing down through the funnel shaped combination path 7, the cross-sectional area in the horizontal direction of the islands-in-sea type composite stream gradually reduces, and the resultant thin composite stream is extruded through an extrusion orifice 8 at the lower end of the combination path 7.

For a spinneret 11 shown in FIG. 2, an island part polymer pool 2 and a sea part polymer pool 5 are connected with guiding paths 13 for an island part polymer composed of a plurality of through-holes. The island part polymer (melt) in the island part polymer pool 2 is distributed into a plurality of the guiding paths 13 for an island part polymer through which the island part polymer is introduced into the sea part polymer pool 5. The introduced island part polymer flows penetrate the sea part polymer (melt) placed in the sea part polymer pool 5. The island part polymer flows then flow into respective paths 6 for core-in-sheath type composite flows, and flow down the central portions of the respective paths 6. On the other hand, the sea part polymer in the sea part polymer pool 5 flows down into the paths 6 for core-in-sheath type composite flows so that each sea part polymer flow surrounds the corresponding island part polymer flow that flows down the central portion of the corresponding path 6. As a result, a plurality of core-in-sheath type composite flows are formed in a plurality of the paths 6 for core-in-sheath type composite flows, and flow down into a funnel-like combining flow path 7. Similarly to the processing in the spinneret in FIG. 1, an islands-in-sea type composite flow is thus formed, and the composite flow flows down while the cross-sectional area in the horizontal direction is being gradually reduced, followed by extruding the composite flow through an extrusion orifice 8.

The extruded islands-in-sea type composite fiber is solidified with a cooling wind, and is wound at a speed of preferably from 400 to 6,000 m/min, more preferably from 1,000 to 3,500 m/min. When the spinning speed is 400 m/min or less, the productivity is inadequate. Moreover, when the speed is 6,000 m/min or more, the spinning stability becomes poor.

The undrawn fiber thus obtained is drawn to give a drawn composite fiber having a tensile strength, an elongation at break and a thermal shrinkage that are desired. Alternatively, the undrawn fiber may also be taken up with a roller at a constant speed without winding, subsequently drawn, and then wound. Specifically, the following procedure is preferred: the undrawn fiber is preheated with a preheating roller at a temperature of 60 to 190° C., preferably 75 to 180° C., and drawn at a draw ratio of 1.2 to 6.0, preferably 2.0 to 5.0; the drawn fiber is heat set on a heat setting roller at a temperature of 120 to 220° C., preferably 130 to 200° C. When the preheating temperature is insufficient, an aimed high draw ratio cannot be attained. When the setting temperature is too low, the shrinkage of the drawn fiber thus obtained is unpreferably excessively high. Moreover, when the setting temperature is excessively high, the drawn fiber thus obtained has significantly poor physical properties, unpreferably.

In the production process of the present invention, in order to produce an islands-in-sea type composite fiber having a particularly fine island part thickness with great efficiency, it is preferred to employ a fluidization drawing step that makes a fiber thickness alone fine without changing the fiber structure, prior to neck drawing (orientation crystallization drawing) involving conventional so-called orientation crystallization. In order to make the fluidization drawing easy herein, it is preferred to uniformly preheat the fiber with a water medium having a large heat capacity, and draw at a low speed. When such a procedure is conducted, the fiber structure is likely to form a fluidized state during drawing, and the fiber can be easily drawn without developing a fine fiber structure. When the pre-fluidization drawing is to be conducted, it is particularly preferred that both the sea part polymer and the island part polymer be polymers having glass transition temperatures of 100° C. or less. Of polymers, polyesters such as a PET, a PBT, a polylactic acid and a polytrimethylene terephthalate are appropriately used. Specifically, the following procedure is preferred: the taken-up composite fiber is pre-fluidization drawn at a draw ratio of 10 to 30, a feed speed of 1 to 10 m/min and a winding speed of 300 m/min or less, 10 to 300 m/min in particular while the composite fiber is being uniformly heated by immersing the composite fiber in a hot water bath at a temperature of 60 to 100° C., preferably 60 to 80° C. When the preheating temperature is inadequate and the drawing speed is too high, an aimed high draw ratio cannot be attained.

The pre-drawn fiber having been pre-drawn in the above-fluidized state is orientation crystallization drawn at a temperature of 60 to 150° C. in order to improve the mechanical properties such as a strength and an elongation. When drawing is conducted at a temperature outside the above range, the physical properties of the fiber thus obtained become unsatisfactory. In addition, the above draw ratio can be determined in accordance with conditions such as melt spinning conditions, fluidization drawing conditions and orientation crystallization drawing conditions. However, it is generally preferred to set the draw ratio in a range from 0.6 to 0.95 that is a maximum possible draw ratio under the orientation crystallization drawing conditions.

The CV % value that represents a variability in thickness of individual fine fibers having a thickness of 10 to 1,000 nm and obtained by dissolving and removing the sea part from the islands-in-sea type composite fiber of the invention is preferably 0 to 25%, more preferably 0 to 20% and still more preferably 0 to 15%. A low CV % value signifies that a variability in thickness is small. Because the use of a fine fiber bundle having a decreased variability in an individual fiber thickness makes it possible to adjust the fiber thickness of the individual fine fibers in the order of nanometers, articles can be designed in accordance with applications. For example, for use in filters, selection of a material capable of conducting adsorption in an individual fine fiber thickness makes it possible to design a fiber thickness in accordance with a specific application. Articles can therefore be designed very efficiently.

The fine fiber bundle obtained by dissolving and removing the sea part from the islands-in-sea type composite fiber of the present invention and composed of fine fibers having a thickness of 10 to 1,000 nm preferably has a tensile strength of 1.0 to 6.0 cN/dtex, an elongation at break of 15 to 60% and a dry heat shrinkage at 150° C. of 5 to 15%. It is important that the fine fiber bundle have physical properties, a tensile strength in particular of 1.0 cN/dtex or more. When the tensile strength is lower than the above value, the applications of the composite fiber are restricted. According to the present invention, a fine fiber bundle having a strength that may allow the fiber bundle to be applied to and developed for various applications, and properties that have never been observed, can be obtained.

One of the properties that have never been observed is that the fine fiber bundle of the invention has a large specific surface area. The fine fiber bundle therefore has excellent adsorbing and absorbing-properties. The effects may be utilized, and new applications may be developed by, for example, making the fine fiber bundle absorb functional pharmaceuticals. Examples of the pharmaceuticals include pharmaceuticals for promoting health and beauty such as proteins and vitamins, and medicines such as anti-inflammatory and anti-infective. On the other hand, the fine fiber bundle of the invention has not only absorbing and adsorbing properties but also excellent sustained releasing properties. By utilizing the effects, the fine fiber bundle may be developed into various medical and sanitary applications including drug delivery systems by which, for example, the above functional pharmaceuticals are subjected to sustained release.

Examples of the textile products having the fine fiber bundle of the invention at least partly include intermediate products such as yarns, braid-like yarns, spun yarns composed of short fibers, woven fabrics, knitted fabrics, felts, nonwoven fabrics and synthetic leathers. These intermediate products can be used for clothes such as jackets, skirts, pants and underwear, sportswear, clothing materials, interior materials such as carpets, sofas and curtains, interior articles for vehicles such as car sheets, cosmetics, beauty masks, wiping cloths, home life applications such as articles for health, applications to environment-maintaining materials and industrial materials such as abrasive cloths, filters, products for removing toxic materials and separators for batteries, and medical applications such as suture threads, scaffolds, artificial veins and blood filters.

Figure 3:
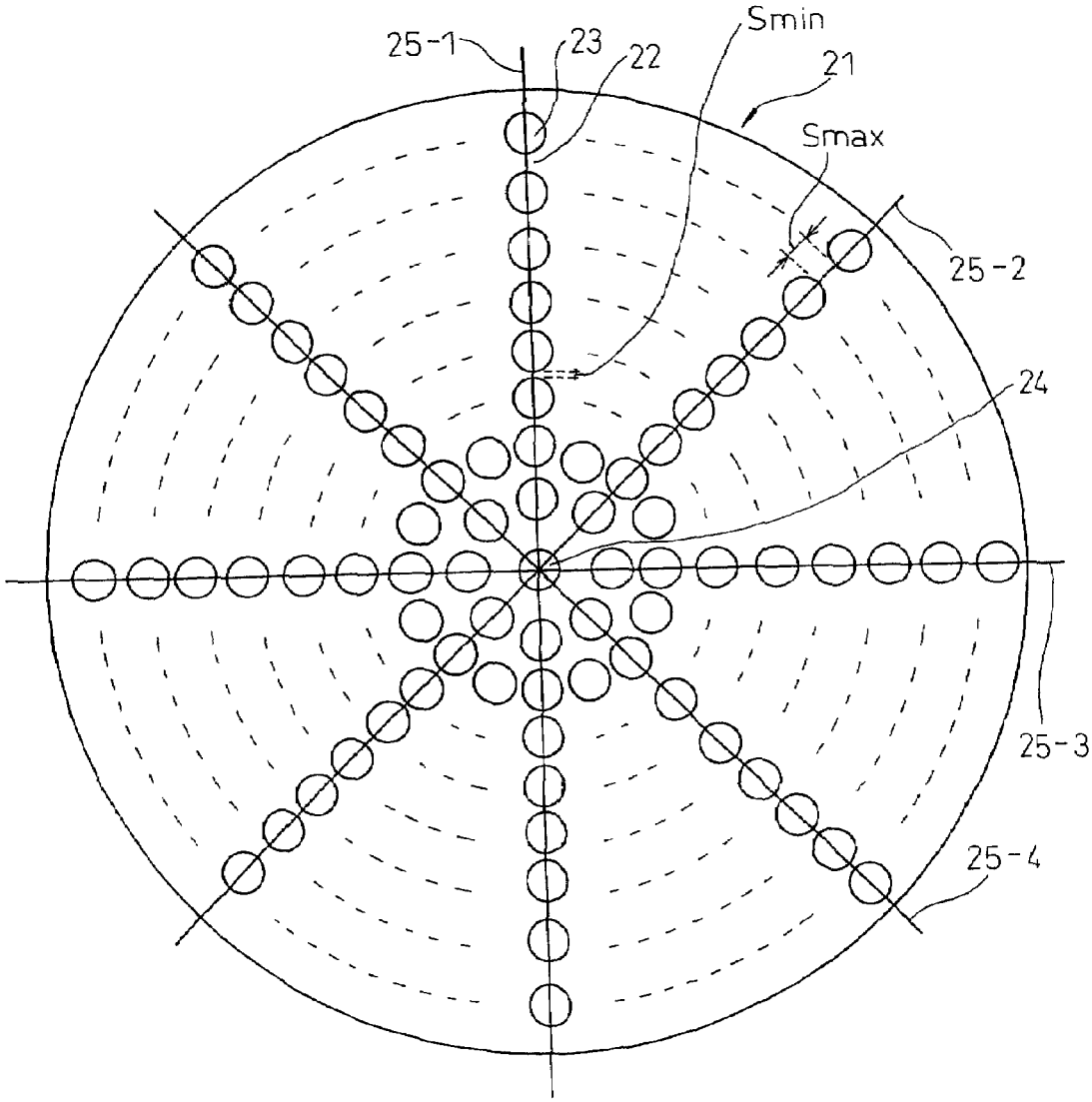
FIG. 3 is a cross-sectional explanatory view of one embodiment of the islands-in-sea type composite fiber of the present invention.

FIG. 3 is a cross-sectional explanatory view of one embodiment 21 of an islands-in-sea type composite fiber according to the present invention. The composite fiber comprises a sea part 22 that forms a matrix, and many island parts 23 arranged therein to be apart from each other. A method of measuring the intervals between island parts is explained below. Four straight lines 25-1, 25-2, 25-3 and 25-4 passing through a center 24 of the cross section are drawn in the cross section at angular intervals of 45 degrees. The intervals of island parts on the four straight lines are measured. Of the intervals, a largest interval $S_{max}$ and a smallest interval $S_{min}$ are determined, and the average value $S_{ave}$ of the island part intervals is calculated. In FIG. 3, island parts on the four straight lines are mainly described, and description of other island parts is omitted.

EXAMPLES

The present invention is further explained by making reference to the following examples.

In examples and comparative examples explained below, measurements and evaluations explained below have been made.

(1) Melt Viscosity

A sample polymer is dried, and placed in an orifice set at the melting temperature of an extruder for melt spinning. The sample polymer is held in a molten state for 5 minutes, and extruded under a load at a predetermined level. The shear speed and the melt viscosity during the extrusion are plotted. The above procedure is repeated under load at a plurality of levels. A shear speed-melt viscosity curve is prepared on the basis of the above data. A melt viscosity at a shear speed of 1,000 $sec^{-1}$ is estimated from the curve.

(2) Measurement of Dissolving Rate

A sea part polymer and an island part polymer are respectively extruded through a spinnerets having an extrusion orifice with 24 nozzles having a thickness of 0.3 mm and a land length of 0.6 mm. The extruded fibers were wound at a speed of 1,000 to 2,000 m/min, and drawn. The elongation at break is adjusted to 30 to 60% to give multifilaments having a yarn count of 75 dtex/24 filaments. The multifilaments are dissolved at a predetermined temperature in a bath containing a solvent with a bath ratio of 50. The reduction rate is calculated from the dissolving time and the dissolved amount.

When the ratio of a dissolving rate of the sea part polymer of a sample islands-in-sea type composite fiber to a dissolving rate of the island part polymer is 200 or more, the dissolving separation performance of the islands-in-sea type composite fiber is evaluated and represented as 2 (good). When the ratio is less than 200, it is evaluated and represented as 1 (poor). Moreover, when the above melt spinning step can be continuously operated for 7 hours or more, the melt spinnability is evaluated and represented as good, and it is evaluated and represented as not good in the other cases.

(3) Observation of Cross Section

Using a transmission type electron microscope (TEM), the cross-sectional photograph of a sample islands-in-sea type composite fiber is taken at a magnification of 30,000×. The electron microscopic photograph is used, and the thickness R of the composite fiber and the thickness r of the island part are determined. Moreover, four straight lines passing through the center of the composite fiber in the cross-sectional photograph and crossing each other at angular intervals of 45 degrees are drawn. A largest interval $S_{max}$ and a smallest interval $S_{min}$ between island parts on the four straight lines are determined, and the average interval $S_{ave}$ between the island parts is calculated.

(4) Variation (CV %) in Individual Fine Fiber Thickness

The sea part of a sample islands-in sea type composite fiber is removed with a solvent. The thus obtained fine fiber bundle composed of an island part polymer is observed with a transmission type electron microscope (TEM) at a magnification of 30,000×, and the thickness of the individual fine fibers is determined. The standard deviation (σ) of the thickness and the average fine fiber thickness (r) are calculated. The variation (CV %) is calculated from the following formula:

$$CV\% = (\text{standard deviation } \sigma / \text{average fiber thickness } r) \times 100$$

The cross section of the fine fiber bundle is observed with a TEM at a magnification of 30,000×, and the average individual fine fiber thickness (r) is an average value of the major axes and the minor axes of the individual fine fibers measured.

(5) Uniformity of Island Parts

A sample islands-in-sea type composite fiber is treated with a solvent for the sea part. When a mass reduction corresponding to the sea part content is observed, the dissolving treatment is stopped. The cross section of the fine fiber bundle thus obtained is observed with a TEM, and the uniformity of the island parts is evaluated and represented as 1 (uniform) or 2 (nonuniform) on the basis of the uniformity of the cross sections of the individual fine fibers.

(6) Stress-strain Curve, Elongation at Partial Break $I_p$ and Elongation at Total Break $I_t$ A sample composite fiber having an initial sample length of 100 nm is pulled with a tensile testing machine at a pulling speed of 200 m/min at room temperature, and a stress-strain curve of the sample composite fiber is obtained. When a yield point (elongation at partial break $I_p$) corresponding to a partial break of the sea part is manifested, the elongation at total break $I_t$ and the elongation at partial break ($I_p$) are determined from the above stress-strain curve chart, and the difference (elongation at total break $I_t$)−(elongation at partial break $I_p$) is calculated.

(7) Thickness of Fine Fiber Bundle

The thickness of a sample fine fiber bundle is calculated from the following formula:

$$\text{thickness of a fine fiber bundle} = D \times (1 - R_a)$$

wherein D is a thickness of the sample islands-in-sea type composite fiber (determined by the method described in (3) Observation of Cross Section), and $R_a$ is a dissolving and removal ratio (measured by the method described in (2) Measurement of Dissolving Rate).

(8) Tensile Strength and Elongation at Break of Fine Fiber Bundle

A tubular knitted fabric having a mass of 1 g or more is prepared from an islands-in-sea type composite fiber, and the knitted fabric is treated with a solvent so that the sea part is removed. The thus obtained knitted fabric composed of a fine fiber bundle is unknitted. The stress-strain curve of the fine fiber bundle thus obtained is prepared with a sample having an initial sample length of 100 mm at a pulling speed of 200 m/min at room temperature. The tensile strength (cN/dtex) and the elongation (%) at break of the fine fiber bundle are determined from the above chart.

(9) Dry Heat Shrinkage

A sample fine fiber bundle is wound around a hank frame, having a peripheral length of 12.5 cm, 10 times to give a hank. The length $L_0$ is measured under a load of 1/30 cN/dtex. The load is removed from the hank, and the hank in a free state is placed in a constant temperature drying oven, and is heat treated at 150° C. for 30 minutes. A load of 1/30 cN/dtex is applied to the dried hank, and the length $L_1$ of the hank after dry heat treatment is measured. The dry heat shrinkage DHS of the fine fiber bundle is calculated from the following formula:

$$DHS(\%) = [(L_0 - L_1)/L_0] \times 100$$

Examples 1 to 12 and Comparative Example 1 to 6

In each of Examples 1 to 12 and Comparative Examples 1 to 6, an islands-in-sea type composite fiber was produced.

Polymers for island parts and polymers for a sea part used therein are shown in Table 1. In each of the examples and comparative examples, a polymer for a sea part and a polymer for island parts are heated and melted, fed to a spinneret for spinning an islands-in-sea type composite fiber, and extruded at a spinning temperature of 280° C. The extruded fiber was wound on a winding roller at a take-up speed listed in Table 1. The undrawn fiber bundle thus obtained was roller drawn at a drawing temperature and a draw ratio shown in Table 1 (with the exception that in Example 10, the undrawn fiber bundle was fluidization drawn at a draw ratio of 22 in a hot water bath at 80° C., and then roller drawn at a draw ratio of 2.3 at 90° C.). The drawn fiber bundle was heat treated at 150° C., and wound. In Examples 1 to 10, the spinning extrusion flow rate and the draw ratio were adjusted so that each drawn and heat treated fiber bundle had a yarn count of 22 dtex/10 filaments.

Tables 1 and 2 show the results of measuring and evaluating the properties of the islands-in-sea type composite fibers thus obtained.

TABLE 1

| No. | Polymer: Sea part | Polymer: Island parts | Number of island parts | Island parts/sea part mass ratio | Winding speed (m/min) |
|---|---|---|---|---|---|
| Ex. 1 | Modified PET1 | PET1 | 500 | 60/40 | 1500 |
| Ex. 2 | Modified PET1 | PET1 | 500 | 60/40 | 1000 |
| Ex. 3 | Modified PET1 | PET1 | 500 | 80/20 | 1500 |
| Ex. 4 | Modified PET1 | PET1 | 500 | 95/5 | 1500 |
| Ex. 5 | Modified PET5 | PET1 | 900 | 70/30 | 3500 |
| C. Ex. 1 | Modified PET1 | PET1 | 100 | 50/50 | 1500 |
| C. Ex. 2 | Modified PET1 | PET1 | 25 | 70/30 | 1500 |
| C. Ex. 3 | Modified PET2 | PET1 | 100 | 80/20 | 1500 |
| C. Ex. 4 | Modified PET3 | PET1 | 500 | 80/20 | 1000 |
| Ex. 6 | NY-6 | PET2 | 500 | 70/30 | 1500 |
| Ex. 7 | Modified PET1 | NY-6 | 500 | 70/30 | 1500 |
| Ex. 8 | Polylactic Acid | PET3 | 500 | 80/20 | 1500 |
| Ex. 9 | Modified PBT | PET3 | 500 | 80/20 | 1500 |
| Ex. 10 | Polystyrene | PET3 | 500 | 90/10 | 1500 |
| Ex. 11 | Modified PET4 | PET1 | 1000 | 70/30 | 1500 |
| Ex. 12 | Modified PET5 | PET1 | 1000 | 70/30 | 1500 |

TABLE 1-continued

| No. | Spinnability | Ratio in dissolving rate of sea part/island parts | Average value of intervals between island parts $S_{ave}$ (nm) | $S_{min}/r$ | $S_{max}/R$ |
|---|---|---|---|---|---|
| Ex. 1 | good | 2 | 250 | 0.48 | 0.05 |
| Ex. 2 | good | 2 | 250 | 0.48 | 0.05 |
| Ex. 3 | good | 2 | 180 | 0.30 | 0.01 |
| Ex. 4 | good | 2 | 75 | 0.12 | 0.009 |
| Ex. 5 | good | 2 | 60 | 0.14 | 0.03 |
| C. Ex. 1 | good | 2 | 520 | 0.49 | 0.1 |
| C. Ex. 2 | good | 2 | 1200 | 0.48 | 0.03 |
| C. Ex. 3 | good | 2 | — | — | — |
| C. Ex. 4 | good | 1 | 180 | 0.3 | 0.05 |
| Ex. 6 | good | 2 | 200 | 0.32 | 0.03 |
| Ex. 7 | good | 2 | 190 | 0.34 | 0.03 |
| Ex. 8 | good | 2 | 180 | 0.31 | 0.01 |
| Ex. 9 | good | 2 | 180 | 0.29 | 0.01 |
| Ex. 10 | good | 2 | 110 | 0.18 | 0.009 |
| Ex. 11 | good | 2 | 90 | 0.14 | 0.02 |
| Ex. 12 | good | 2 | 20 | 0.24 | 0.02 |

TABLE 2

| | Yield point in a L-El curve | $I_t$-$I_p$ (%) | Drawing temp.: Pre-heating temp. (° C.) | Drawing temp.: Heat setting temp. (° C.) | Draw ratio | Fine fiber bundle: TS (cN/dtex) | Fine fiber bundle: El at break (%) | Individual fine fibers: Thickness (dtex) | Individual fine fibers: Thickness (nm) | CV % |
|---|---|---|---|---|---|---|---|---|---|---|
| Ex. 1 | present | 60 | 80 | 180 | 2.5 | 2.5 | 75 | 0.002 | 520 | 9.4 |
| Ex. 2 | present | 60 | 90 | 180 | 4.5 | 5.9 | 40 | 0.002 | 520 | 9.7 |
| Ex. 3 | absent | 0 | 80 | 180 | 2.5 | 3.0 | 70 | 0.003 | 600 | 10.1 |
| Ex. 4 | absent | 0 | 90 | 180 | 2.7 | 4.0 | 55 | 0.004 | 650 | 9.9 |
| Ex. 5 | present | 120 | 90 | 180 | 2.3 | 3.8 | 55 | 0.002 | 420 | 12.6 |
| C. Ex. 1 | absent | 0 | 80 | 180 | 2.5 | 2.3 | 120 | 0.010 | 1060 | 30.0 |
| C. Ex. 2 | absent | 0 | 80 | 180 | 2.8 | 3.1 | 35 | 0.056 | 2510 | 32.0 |
| C. Ex. 3 | present | 35 | 80 | 180 | 2.2 | 2.9 | 30 | — | — | — |
| C. Ex. 4 | absent | 0 | 80 | 180 | 1.8 | 0.9 | 100 | 0.003 | 590 | — |
| Ex. 6 | absent | 0 | 70 | 140 | 3.0 | 2.0 | 45 | 0.003 | 630 | 11.5 |
| Ex. 7 | absent | 0 | 80 | 140 | 3.0 | 2.5 | 66 | 0.003 | 560 | 13.3 |
| Ex. 8 | absent | 0 | 70 | 140 | 2.0 | 2.4 | 80 | 0.003 | 580 | 12.2 |
| Ex. 9 | absent | 0 | 70 | 140 | 1.9 | 1.9 | 55 | 0.003 | 620 | 12.5 |
| Ex. 10 | absent | 0 | 80 | 140 | 2.9 | 2.3 | 50 | 0.004 | 600 | 9.5 |
| Ex. 11 | absent | 0 | 80 | 200 | 2.7 | 2.8 | 45 | 0.001 | 640 | 15.1 |
| Ex. 12 | absent | 0 | 80*1<br>90*2 | 150 | 22*3<br>2.3*4 | 1.5 | 50 | 0.00006 | 85 | 17.1 |

Note:
L-El = Stress-strain
$I_t$ = Elongation at total break
$I_p$ = Elongation at partial break
El = Elongation
TS = Tensile Strength
*1hot water bath temperature
*2heating roller temperature
*3draw ratio in a hot water bath
*4draw ratio with a heating roller Polymers listed in Table 1 are explained below.

PET1: a polyethylene terephthalate having a melt viscosity of 120 Pa·s at 280° C.

PET2: a polyethylene terephthalate having a melt viscosity of 125 Pa·s at 280° C., and a titanium oxide content of 0.3% by weight PET3: a polyethylene terephthalate having a melt viscosity of 60 Pa·s at 270° C.

NY-6: a nylon 6 having a melt viscosity of 140 Pa·s at 280° C.

Modified PET1: a polyethylene terephthalate in which 6% by mole of 5-sodium sulfoisophthalate and 6% by weight of a polyethylene glycol having a number average molecular weight of 4,000 and that has a melt viscosity of 175 Pa·s at 280° C.

Modified PET2: a polyethylene terephthalate in which 2% by mole of 5-sodium sulfoisophthalate and 10% by weight of a polyethylene glycol having a number average molecular weight of 4,000 are copolymerized and that has a melt viscosity of 75 Pa·s at 280° C.

Modified PET3: a polyethylene terephthalate in which 3% by weight of a polyethylene glycol having a number average molecular weight of 4,000 is copolymerized and that has a melt viscosity of 200 Pa·s at 280° C.

Modified PET4: a polyethylene terephthalate in which 8% by mole of 5-sodium sulfoisophthalate and 30% by weight of a polyethylene glycol having a number average molecular weight of 4,000 are copolymerized and that has a melt viscosity of 155 Pa·s at 280° C.

Modified PET5: a polyethylene terephthalate in which 9% by mole of 5-sodium sulfoisophthalate and 3% by weight of a polyethylene glycol having a number average molecular weight of 4,000 are copolymerized and that has a melt viscosity of 135 Pa·s at 280° C.

Polylactic acid: a polylactic acid having a melt viscosity of 175 Pa·s at 270° C. and a purity of 99% based on a D-form Modified PBT: a polybutylene terephthalate in which 5% by mole of 5-sodium sulfoisophthalate and 50% by weight of a polyethylene glycol having a number average molecular weight of 4,000 are copolymerized and that has a melt viscosity of 80 Pa·s at 270° C.

Polystyrene: a polystyrene having a melt viscosity of 100 Pa·s at 270° C.

In Example 1, PET1 and Modified PET1 were, respectively, used for island parts and a sea part in a ratio of 60:40. The islands-in-sea type composite fiber thus obtained achieved formation of an islands-sea cross section wherein the thickness between island parts was small, and the island part thickness were uniform. In the stress-strain curve at room temperature of the composite fiber, the yield point corresponding to the partial break of the sea part was not manifested. The cross section of the composite fiber was observed with a TEM, and the relationships among an island part thickness (r), a smallest interval ($S_{min}$) among island parts, a composite fiber thickness (R) and a largest interval ($S_{max}$) among island parts were investigated. The results thus obtained were as follows: $S_{min}/r=0.48$; and $S_{max}/R=0.05$. A tubular knitted fabric was prepared from a drawn yarn having been obtained by roller drawing at a drawing temperature and a draw ratio listed in Table 2, and reduced by 40% with a 4% NaOH aqueous solution at 95° C. When the cross section of the fine fiber bundle thus obtained was observed, a group of fine fibers having a uniform individual fine fiber thickness were formed. The tensile strength and elongation at break of the fine fiber bundle subsequent to reducing the sea part were 2.5 cN/dtex and 75%, respectively.

In Example 2, the same islands-in-sea type composite fiber as in Example 1 was used, and roller drawn at a drawing temperature and a draw ratio listed in Table 2. A tubular knitted fabric was prepared from the drawn yarn, and reduced by 40% with a 4% NaOH aqueous solution at 95° C. When the cross section of the fine fiber bundle thus obtained was observed, a group of fine fibers having a uniform individual fine fiber thickness were formed. The tensile strength and elongation at break of the fine fiber bundle subsequent to reducing the sea part were 5.9 cN/dtex and 40%, respectively.

In Example 3, the same sea part polymer and the same island part polymer as in Example 1 were used, and spinning was conducted in an islands/sea ratio of 80/20. The islands-in-sea type composite fiber thus obtained achieved formation of an islands-sea cross section wherein the thickness between island parts was small, and the island part thickness were uniform. The cross section of the raw yarn was observed with a TEM, and the relationships among an island part thickness (r), a smallest interval ($S_{min}$) among island parts, a composite fiber thickness (R) and a largest interval ($S_{max}$) among island parts were investigated. The results thus obtained were as follows: $S_{min}/r=0.30$; and $S_{max}/R=0.01$. A tubular knitted fabric was prepared from a drawn yarn having been obtained by roller drawing at a drawing temperature and a draw ratio listed in Table 2, and reduced by 20% with a 4% NaOH aqueous solution at 95° C. When the cross section of the fine fiber bundle thus obtained was observed, a group of fine fibers having a uniform individual fine fiber thickness were formed. The tensile strength and elongation at break of the fine fiber bundle subsequent to removing the sea part were 3.0 cN/dtex and 70%, respectively.

In Example 4, the same sea part polymer and the same island part polymer as in Example 1 were used, and spinning was conducted in an islands/sea ratio of 95/5. Although the proportion of the sea part was very small, because the melt viscosity of the sea part was high, the sea-island cross section formability was good. The cross section of the raw yarn was observed with a TEM, and the relationships among an island part thickness (r), a smallest interval ($S_{min}$) among island parts, a composite fiber thickness (R) and a largest interval ($S_{max}$) among island parts were investigated. The results thus obtained were as follows: $S_{min}/r=0.12$; and $S_{max}/R=0.009$. A tubular knitted fabric was prepared from a drawn yarn having been obtained by roller drawing at a temperature and a draw ratio listed in Table 2, and reduced by 5% with a 4% NaOH aqueous solution at 95° C. When the cross section of the fine fiber bundle thus obtained was observed, a group of fine fibers having a uniform individual fine fiber thickness were formed. The tensile strength and elongation at break of the fine fiber bundle subsequent to removing the sea part were 4.0 cN/dtex and 55%, respectively.

In Example 5, PET1 and Modified PET5 were used for island parts and a sea part, respectively, and an islands-in sea type composite fiber was produced by spinning in a sea/islands mass ratio of 30/70. The elongation at break of the island parts was higher than that of the sea part, and the sea/islands alkali reduction rate ratio of the composite fiber was 2,000. The yield point corresponding to the partial break of the sea part was manifested in the stress-strain curve at room temperature. The difference between an elongation at the intermediate yield point and an elongation at break was 120%. When the cross section of the raw yarn was observed with a TEM, the sea-island cross section formability was good. The relationships among an island part thickness (r), a smallest interval ($S_{min}$) among island parts, a composite fiber thickness (R) and a largest interval ($S_{max}$) among island parts were investigated. The results thus obtained were as follows: $S_{min}/r=0.14$; and $S_{max}/R=0.03$. A tubular knitted fabric was prepared from a drawn yarn having been obtained by drawing at a draw ratio of 2.3, and reduced by 30% with a 4% NaOH aqueous solution at 95° C. When the cross section of the fine fiber bundle thus obtained was observed, a group of fine fibers having a uniform fiber thickness were formed. The tensile strength and elongation at break of the fine fiber bundle subsequent to removing the sea part were 3.8 cN/dtex and 55%, respectively.

In Comparative Example 1, the same sea part polymer and the same island part polymer as in Example 1 were used, and spinning and drawing were conducted while the number of islands and the islands/sea mass ratio were being set at 100 and 50/50, respectively. The cross section formability of the drawn fiber was good. However, because an amount of the sea part was excessive, the sea part thickness among islands was large, and the uniformity of the fine fibers obtained by sea part removal with alkali treatment was inadequate. When the sea part in the central portion of the composite fiber was being dissolved and removed, island parts exposed by the removal of the sea part in the fiber surface portion suffered the alkali reduction treatment. As a result, the nonuniformity of the fine fibers was produced. Moreover, fibrils to become a source of generating uneven dyeing quality and a source of generating pilling due to friction were formed on the fine fiber bundle here and there. Furthermore, because the thickness of the sea part was large, the draw ratio could not be raised. As a result, the tensile strength of the fine fiber bundle obtained by the sea part removal was 0.9 cN/dtex, a practically insufficient value.

In Comparative Example 2, because the number of islands was 25, the nonuniformity of the island parts was more significant than in Comparative Example 1.

In Comparative Example 3, PET1 and Modified PET2 were used for island parts and a sea part, respectively, in a ratio of 80/20. Because the melt viscosity of the sea part polymer is lower than that of the island part polymer, 90% or more of the island parts were mutually bonded to form a cross-sectional profile in which the sea part surrounded the periphery of the bonded island parts. Accordingly, removal of the sea part with alkali reduction could not form a fine fiber bundle.

In Comparative Example 4, PET1 and Modified PET3 were used for island parts and a sea part, respectively, in ratio of 80/20. The formability of the sea and the islands was good. However, because the alkali reduction rate of the sea part was insufficient in comparison with that of the island parts, a significant amount of islands on the composite fiber surface was reduced; most of the sea part distributed in the central portion of the composite fiber remained without reduction, although a considerable amount of the sea part was removed. As a result, a softness specific to a fine fiber bundle was not obtained.

In Example 6, PET2 and NY-6 were used for island parts and a sea part, respectively, and spinning was conducted in an islands/sea ratio of 70/30. Because the melt viscosity of the island part polymer was high, the formability of the sea part and the island parts was good. In the stress-strain curve at room temperature, the yield point corresponding to the partial break of the sea part was not manifested, and the curve was an ordinary one. The cross section of the raw yarn was observed with a TEM, and the sea-island cross section formability was good. The relationships among an island part thickness (r), a smallest interval ($S_{min}$) among island parts, a composite fiber thickness (R) and a largest interval ($S_{max}$) among island parts were investigated. The results thus obtained were as follows: $S_{min}/r=0.32$; and $S_{max}/R=0.03$. A tubular knitted fabric was prepared from a drawn yarn having been obtained by drawing at a draw ratio of 3.0, and dissolving treatment was conducted at room temperature in formic acid that dissolves NY-6 (sea part) alone. Because PET (island parts) was not, substantially, dissolved in formic acid, the uniformity of the island parts was good due to a sufficient difference in a dissolving rate between the two polymers.

In Example 7, NY-6 used as a sea part polymer in Example 5 was used as an island part polymer, and Modified PET1 used in Example 1 was used as a sea part polymer, followed by conducting spinning and drawing in the same manner as in Example 5. The sea-island cross section formability was good. The yield point corresponding to a partial break of the sea part was not manifested in the stress-strain curve. A fine fiber bundle could be produced by dissolving and removing the sea part with a 4% NaOH aqueous solution at 90° C.

In Example 8, PET3 and Polylactic Acid were used as an island part polymer and a sea part polymer, respectively, and spinning and drawing were conducted in an islands/sea mass ratio of 80/20. An alkali aqueous solution reduction rate of Polylactic Acid was very quick, and a fine fiber bundle was formed in a short period of time. Moreover, the uniformity of the individual fine fiber thickness was good.

In Example 9, the same island part polymer as in Example 7 and Modified PBT were used as an island part polymer and a sea part polymer, respectively, and melt spinning was conducted. The sea-island cross-section formability was good. Moreover, because the alkali reduction rate of the sea part was very quick, a fine fiber bundle excellent in uniformity, and having a soft feel and no unevenness, could be obtained, similarly to Example 7.

In Example 10, the same island part polymer as in Example 8 and Polystyrene were used as an island part polymer and a sea part polymer, respectively, and spinning was conducted in an islands/sea mass ratio of 90/10. The sea part of the drawn yarn thus obtained was dissolved and removed at 60° C. with toluene used as the solvent. The fine fiber bundle thus obtained had a good quality.

In Example 11, the same island part polymer as in Example 1 and Modified PET 4 were used as an island part polymer and a sea part polymer, respectively. Drawing was conducted at an islands/sea mass ratio of 70/30 while the number of islands was being set at 1,000. Because the PEG content of the sea part polymer was increased, the alkali reduction rate thereof was high, and a good fine fiber bundle could be prepared regardless of the number of islands of 1,000.

In Example 12, the same island polymer as in Example 1 and Modified PET5 were used as an island part polymer and a sea part polymer, respectively, and melt spinning was conducted at a take-up speed of 1,000 m/min in an islands/sea mass ratio of 70/30, while the number of islands was being set at 1,000. The undrawn yarn thus obtained was cohered to form a tow of 2,200,000 dtex. The tow was fed to a hot water bath at 80° C. at a feed speed of 5 m/min while the immersion length within the bath was set at 2 m, and drawn at a draw ratio of 22, followed by taking up at a winding speed of 110 m/min. Water on the drawn fiber was blown off by an air jet, and the fiber was preheated with a roller at 90° C. The preheated fiber was then neck drawn at a draw ratio of 2.3, heat treated with a heat setting roller at 150° C., and wound at a speed of 250 m/min. The operation efficiency in the reduction step of the resultant composite fiber in a 4% NaOH aqueous solution was good, and a fine fiber bundle having a very small individual fiber thickness was obtained.

In Example 13, a plain weave fabric was prepared from the islands-in-sea type composite fiber having been prepared in Example 10. The plain weave fabric was then scoured, subjected to reduction in a 4% NaOH aqueous solution (reduction by 30%), dyed, and final set. The thus obtained plain weave fabric formed from fine fiber bundles having an individual fiber thickness of 640 nm had no uneven dyeing, and was an interesting woven fabric that was likely to entangle hands. When the woven fabric was calendared, a sheet that had a film-like appearance and feel and that did not seem to be a woven fabric was obtained.

INDUSTRIAL APPLICABILITY

Because the sea part can be easily dissolved and removed from the islands-in-sea type composite fiber of the present invention, the composite fiber can provide a multifilament yarn composed of fine fiber bundle excellent in uniformity of an individual fiber thickness with good productivity at low cost. The composite fiber can therefore be appropriately used in various application fields where further miniaturization of a fiber is required.

The invention claimed is:

1. A fine fiber bundle obtained from an islands-in-sea type composite fiber comprising a sea part comprising an easily-soluble polymer and a plurality of 100 or more island parts comprising a hardly-soluble polymer, in a cross-sectional profile of which each of the island parts has a thickness in the range of from 10 to 1,000 nm and the intervals between the island parts adjacent to each other are 500 nm or less, by dissolving and removing the sea part from the composite fiber, and having:

a number of individual fine fibers of 100 or more per bundle, a thickness of the individual fine fibers in the range of from 10 to 1,000 nm, a tensile strength in the range of from 1.0 to 6.0 cN/dtex, and an elongation at break in the range of from 15 to 60%.

2. The fine fiber bundle as claimed in claim 1, wherein the individual fine fibers in the fine fiber bundle have a variability (CV %) in thickness of 0 to 25%.

3. A textile product comprising a fine fiber bundle as claimed in any one of claim 1.

4. The textile product, as claimed in claim 3, in the form of a woven or knitted fabric, a felt, a nonwoven fabric, a braid-like yarn or a spun yarn.

5. The textile product, as claimed in claim 3, selected from clothing, interior materials, industrial materials, home life materials, environment-maintaining materials, and medical and sanitary materials.

6. The fine fiber bundle as claimed in claim 1, wherein the variability in cross sectional thickness of the island parts represented by CV % is in the range of from 0 to 25%.

7. The fine fiber bundle as claimed in claim 1, being in the form of an undrawn fiber.

8. The fine fiber bundle as claimed in claim 1, being in the form of a drawn fiber.

* * * * *